US011408654B2

(12) United States Patent
Ding et al.

(10) Patent No.: US 11,408,654 B2
(45) Date of Patent: Aug. 9, 2022

(54) ECONOMIZER AND REFRIGERATION SYSTEM HAVING THE SAME

(71) Applicant: Carrier Corporation, Palm Beach Gardens, FL (US)

(72) Inventors: Haiping Ding, Shanghai (CN); Michael Stark, Mooresville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 663 days.

(21) Appl. No.: 16/060,248

(22) PCT Filed: Nov. 30, 2016

(86) PCT No.: PCT/US2016/064168
§ 371 (c)(1),
(2) Date: Jun. 7, 2018

(87) PCT Pub. No.: WO2017/100052
PCT Pub. Date: Jun. 15, 2017

(65) Prior Publication Data

US 2018/0363962 A1 Dec. 20, 2018

(30) Foreign Application Priority Data

Dec. 10, 2015 (CN) ..... 201510907785.5

(51) Int. Cl.
*F25B 43/00* (2006.01)

(52) U.S. Cl.
CPC ..... *F25B 43/00* (2013.01); *F25B 2400/13* (2013.01); *F25B 2400/23* (2013.01); *F25B 2500/01* (2013.01)

(58) Field of Classification Search
CPC ... F25B 43/00; F25B 2400/13; F25B 2400/23
See application file for complete search history.

(56) References Cited

U.S. PATENT DOCUMENTS 3,260,067 A * 7/1966 McClure ..... F25B 1/00 62/505
3,797,566 A 3/1974 Gaffet et al.
(Continued)

FOREIGN PATENT DOCUMENTS

CN 104995464 A 10/2015
EP 2932162 B1 10/2015
(Continued)

OTHER PUBLICATIONS

Senninger, "Wobbler Technology, Irrigating Orchards and Groves", available at: https://www.senninger.com/sites/senninger.hunterindustries.com/files/wobbler-technology-brochure.pdf, accessed Jun. 11, 2018, 12 pages.

(Continued)

*Primary Examiner* — Frantz F Jules
*Assistant Examiner* — Martha Tadesse
(74) *Attorney, Agent, or Firm* — Cantor Colburn LLP

(57) ABSTRACT

The present invention provides an economizer, including a housing having a first section and a second section; and a condenser outlet, an evaporator inlet, and a compressor intermediate-stage inlet that are disposed on the second section of the housing; wherein the first section has a contour matching a housing of a commonly used condenser, such that the first section can fit the housing of the condenser. The economizer of the present invention can better match an outer contour of a conventional condenser, so that the both can fit each other in arrangement as much as possible when applied to an overall layout of a refrigeration system, thereby significantly reducing a transverse space occupied by the refrigeration system.

18 Claims, 2 Drawing Sheets

(56) References Cited

U.S. PATENT DOCUMENTS 4,171,623 A 10/1979 Lavigne et al.
4,209,061 A * 6/1980 Schwemin ..... F28F 13/06 165/10
4,338,887 A 7/1982 Leon
5,634,350 A * 6/1997 De Medio ..... F25B 5/04 62/509
5,692,389 A 12/1997 Lord et al.
5,829,265 A 11/1998 Lord et al.
5,836,382 A 11/1998 Dingle et al.
6,202,438 B1 3/2001 Barito
6,220,050 B1 * 4/2001 Cooksey ..... F04B 39/04 62/503
7,421,855 B2 9/2008 Ring et al.
8,505,331 B2 * 8/2013 Pham ..... F04C 29/042 62/509
9,027,363 B2 * 5/2015 Takada ..... F25B 41/315 96/198
9,822,789 B2 * 11/2017 Oda ..... F25B 1/00
2005/0044883 A1 3/2005 Sishtla
2008/0098754 A1 5/2008 Sommer et al.
2009/0205361 A1 * 8/2009 James ..... F25B 1/06 62/510
2010/0326130 A1 * 12/2010 Takada ..... F25B 41/315 62/430
2011/0056379 A1 * 3/2011 Lucas ..... B01D 45/12 96/216
2011/0174014 A1 * 7/2011 Scarcella ..... F25B 9/008 62/512
2011/0185765 A1 8/2011 Nishii et al.
2012/0318008 A1 * 12/2012 Liu ..... F25B 9/008 62/115
2012/0318014 A1 * 12/2012 Huff ..... F25B 9/008 62/509
2013/0255289 A1 10/2013 Jung
2013/0312376 A1 * 11/2013 Huff ..... F25B 1/10 55/457
2013/0333402 A1 * 12/2013 Styles ..... F25B 43/00 62/89
2015/0096315 A1 * 4/2015 Li ..... F25B 43/00 62/115
2015/0338154 A1 * 11/2015 Senf ..... F25B 5/02 62/196.1
2016/0271542 A1 * 9/2016 Huff ..... F25B 1/10
2018/0066871 A1 * 3/2018 Matsukura ..... F25B 1/053
2018/0209705 A1 * 7/2018 Ding ..... F25B 41/315

FOREIGN PATENT DOCUMENTS

JP 2006343064 A * 12/2006
JP 2006343064 A 12/2006
JP 2007-038039 * 5/2007 ..... F25B 2400/23
WO 2014092850 A1 6/2014
WO 2014106252 A1 7/2014
WO 2014117015 A1 7/2014

OTHER PUBLICATIONS

Senninger, "Xcel-Wobbler UP3 Top for Center Pivots", available at: https://stc.dripdepot.com/files/11212/11212-xcel-wobbler-up3-top-sheet.pdf, accessed Jun. 11, 2018, 2 pages.
International Search Report and Written Opinin for application PCT/US2016/064168, dated Feb. 10, 2017, 10 pages.

* cited by examiner

ECONOMIZER AND REFRIGERATION SYSTEM HAVING THE SAME

TECHNICAL FIELD

The present invention relates to components and parts in a refrigeration system, and more specifically, to an economizer.

BACKGROUND ART

Large commercial refrigeration systems meet high refrigeration load requirements, their components and parts are generally of a large size, and thus they may generally occupy a large system arrangement space. Moreover, when a low-pressure refrigerant is employed in such a refrigeration system, it needs to occupy a relatively larger space due to a larger vapor volume. For example, this may be specifically manifested as a significant increase in the overall arrangement width of the refrigeration system. It can be known according to conventional experiments and empirical data that, for the same volume, a refrigeration system with a design using a low-pressure refrigerant will generally be three times wider than the refrigeration system using a medium-pressure refrigerant. Moreover, the size of an economizer applied to the system will also generally be designed as twice the original size.

In consideration of the excellent performance of the low-pressure refrigerant, on one hand, the consumer desires to use the refrigeration system with the low-pressure refrigerant. However, on the other hand, the consumer does not want to accept the significant increase in the size of the entire refrigeration system caused by the use of the low-pressure refrigerant. This puts forward higher requirements on improvement in terms of both size and performance as well as the balance therebetween during the design of the system.

SUMMARY OF THE INVENTION

An objective of the present invention is to provide an economizer that greatly reduces an occupied arrangement space while ensuring the performance.

Another objective of the present invention is to provide a refrigeration system that greatly reduces an occupied arrangement space while ensuring the performance.

To achieve the aforementioned objectives or other objectives, the present invention provides the following technical solutions.

According to one aspect of the present invention, an economizer is provided, including a housing having a first section and a second section; and a condenser outlet, an evaporator inlet, and a compressor intermediate-stage inlet that are disposed on the second section of the housing; wherein the first section has a contour matching a housing of a commonly used condenser, such that the first section can fit the housing of the condenser.

According to another aspect of the present invention, a refrigeration system is further provided, including the economizer described above, and a condenser; wherein the first section of the economizer is arranged in a manner of fitting the housing of the condenser.

DETAILED DESCRIPTION

Figure 1:
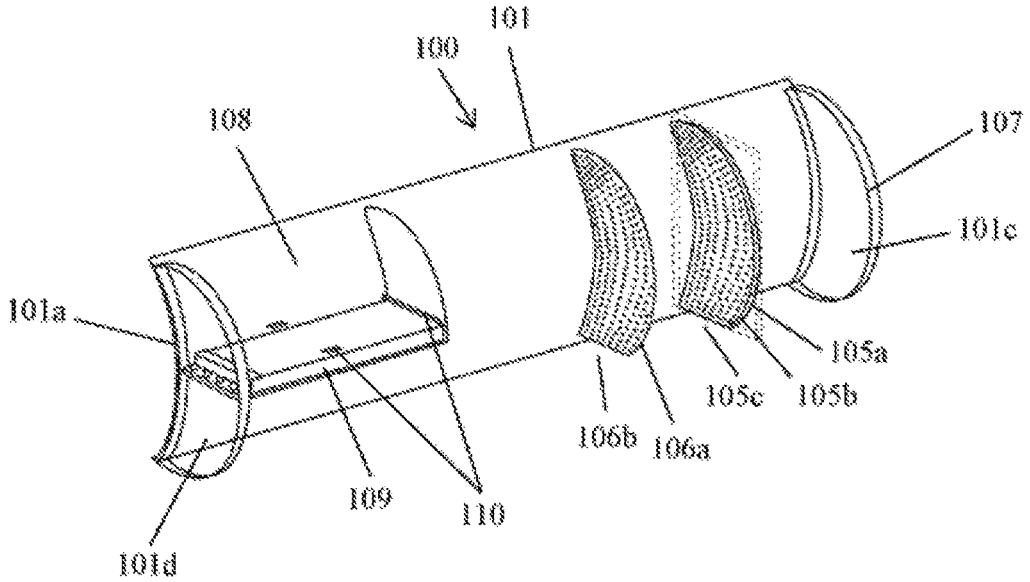
FIG. 1 is a schematic internal structural diagram of an embodiment of an economizer of the present invention.
Figure 2:
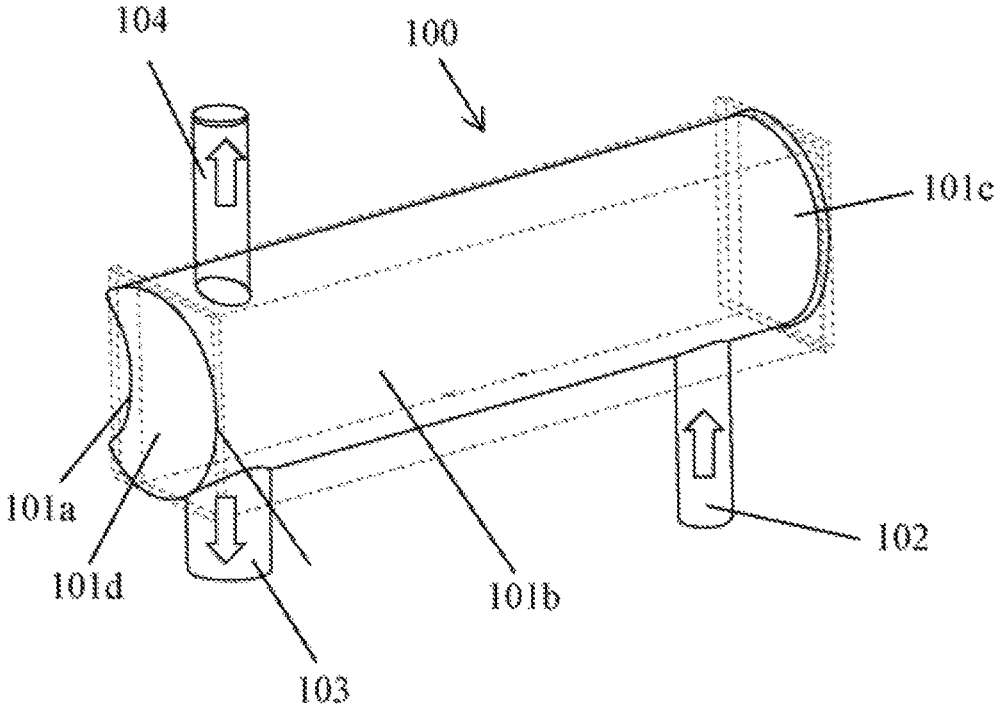
FIG. 2 a schematic external structural diagram of an embodiment of the economizer of the present invention.

Referring to FIG. 1 and FIG. 2, they show a schematic structural diagram of an embodiment of an economizer of the present invention from the inside out. The economizer 100 includes a housing 101 having a first section 101*a* and a second section 101*b*. The second section 101*b* of the housing 101 has a convex curved contour, that is, it corresponds to a part of the contour of a housing of a conventional cylindrical economizer. However, the first section 101*a* of the housing 101 is quite different from the other part of the contour of a housing of a conventional cylindrical economizer, and has a concave curved contour. Such a design is mainly aimed to match the cylindrical outer contour of a conventional condenser, so that the both can fit each other in arrangement as much as possible when applied to an overall layout of a refrigeration system, thereby significantly reducing a transverse space occupied by the refrigeration system.

Certainly, it can be known according to the teaching of the above embodiment of the present invention that, when the commonly used condenser is not in a cylinder shape, the first section 101*a* does not necessarily have a concave curved contour, but only needs to have a contour matching the housing of the commonly used condenser. In this way, the cooperative arrangement of the economizer 100 and the condenser in the refrigeration system can occupy a smaller transverse space, and thus the refrigeration system using the economizer 100 also occupies a smaller space correspondingly.

Also in the embodiment shown in FIG. 1 and FIG. 2, the second section 101*b* has an arc length greater than that of the first section 101*a*, such that the housing 101 as a whole is crescent-shaped, which also improves the structural compressive strength as much as possible while reducing the arrangement space.

In addition, connecting ports of the economizer 100 with other components and parts are also shown in the figures, specifically including a condenser outlet 102, an evaporator inlet 103, and a compressor intermediate-stage inlet 104 that are disposed on the second section 101*b* of the housing. In this embodiment, the condenser outlet 102 is disposed at a lower portion of a first end 101*c* of the housing 101; the evaporator inlet 103 is disposed at a lower portion of a second end 101*d* of the housing 101; and the compressor intermediate-stage inlet 104 is disposed at an upper portion of the second end 101*d* of the housing 101. Such a design can better fit the working principle of the economizer, making a gas-liquid refrigerant that enters the economizer substantially flow from the first end 101*c* of the housing 101 to the second end 101*d* of the housing 101, and making a gas-phase refrigerant enter the compressor intermediate-stage inlet 104 at the second end 101*d* of the housing 101, while making a liquid-phase refrigerant enter the evaporator inlet 103 at the second end 101*d* of the housing 101. Disposing the condenser outlet 102, the evaporator inlet 103, and the compressor intermediate-stage inlet 104 at two ends of the housing 101 of the economizer can achieve gas liquid separation by utilizing the length of the economizer 100 most effectively. Disposing the compressor intermediate-stage inlet 104 at the upper portion of the second end 101*d* would be more favorable for the gas-phase refrigerant to rise and flow thereinto, and disposing the evaporator inlet 103 at the lower portion of the second end 101*d* would be more favorable for the liquid-phase refrigerant to sink and flow thereinto.

Optionally, the economizer 100 further includes a first flow-equalizing portion arranged at the downstream part of the condenser outlet 102 in the housing 101, and the first flow-equalizing portion can exert a flow equalizing function. As an example, the first flow-equalizing portion used in this embodiment are a first flow-equalizing plate 105*a* and a second flow-equalizing plate 105*b* provided with several flow-equalizing holes thereon, and the two plates deviate from each other such that the flow-equalizing holes thereon are staggered by a particular distance. On one hand, the first flow-equalizing plate 105*a* and the second flow-equalizing plate 105*b* can exert the flow equalizing function; on the other hand, the arrangement manner of deviating from each other can further achieve an effect of breaking up larger droplets flowing through the plates, so that separation of the downstream gas-liquid two-phase refrigerant is more thorough. As an optional example, the first flow-equalizing plate 105*a* and the second flow-equalizing plate 105*b* in the figure deviate from each other by 0.5-1 inches. Experiments show that the flow-equalizing effect brought about by such a deviation distance is more prominent.

It can be known based on the above description that the first flow-equalizing plate 105*a* and the second flow-equalizing plate 105*b* herein mainly exert a flow-equalizing function on the gas-liquid two-phase refrigerant. In order to ensure a better effect, the plates should be arranged near the condenser outlet 102 as much as possible.

Optionally, as some of the liquid-phase refrigerant would usually accumulate at the lower portion of the economizer 100 in a working state, a first opening 105*c* is further disposed between the first flow-equalizing plate 105*a* as well as the second flow-equalizing plate 105*b* and an inner wall below the housing 101. The existence of the first opening 105*c* allows the liquid-phase refrigerant to flow from the first end 101*c* to the second end 101*d* of the economizer 100 more smoothly without being severely hindered.

Optionally, in order to provide a better flow-equalizing effect, a second flow-equalizing portion may further be disposed behind the first flow-equalizing portion that mainly exerts the function of breaking up larger droplets, and the second flow-equalizing portion is arranged at the downstream part of the first flow-equalizing portion in the housing 101. With such an arrangement, smaller liquid of the liquid-phase refrigerant, which has passed through the first flow-equalizing portion and has been broken up, as well as the gas-phase refrigerant can be further treated, improving the flow-equalizing effect. As an example, in order to further improve the flow-equalizing effect, in this embodiment, the second flow-equalizing portion is a third flow-equalizing plate 106*a* and is arranged near the middle of the housing 101.

Optionally, as some of the liquid-phase refrigerant would usually accumulate at the lower portion of the economizer 100 in a working state, based on the same reason, a second opening 106*b* is further disposed between the third flow-equalizing plate 106*a* and the inner wall below the housing 101. The existence of the second opening 106*b* allows the liquid-phase refrigerant to flow from the first end 101*c* to the second end 101*d* of the economizer 100 more smoothly without being severely hindered.

Existing as an economizer, the apparatus is required to have an effect of providing air make-up for the intermediate stage of a compressor. In the conventional air make-up of an economizer, if more liquid-phase refrigerant is mixed in the gas-phase refrigerant made up to the compressor, it easily causes problems such as liquid impact in the compressor. Therefore, in order to prevent, as far as possible, the liquid-phase refrigerant from entering the compressor via the compressor intermediate-stage inlet 104, a filter chamber 108 is further disposed in the housing 101 of the economizer, and the filter chamber 108 is arranged such that the compressor intermediate-stage inlet 104 located in the filter chamber is in fluidic communication with the condenser outlet 102 located outside the filter chamber 108 via a filter component. Such a design will ensure that the refrigerant entering the compressor via the compressor intermediate-stage inlet 104 is further filtered, to improve the gas phase purity and avoid the problem of liquid impact. As a better option, on one hand, the compressor intermediate-stage inlet 104 may be arranged above the housing 101 of the economizer, and on the other hand, a filter component may further be disposed below the compressor intermediate-stage inlet 104. As the liquid-phase refrigerant has a greater density than the gas-phase refrigerant, in such a structure, the liquid-phase refrigerant located above, which is originally less, will be almost removed after being further filtered by the filter component, thereby avoiding the possibility that the liquid-phase refrigerant enters the compressor.

Optionally, in this embodiment, as an example, a wire mesh filter 109 is provided, which has a relatively better filtering effect and a more suitable cost orientation.

Optionally, in this embodiment, as an example, a mounting manner is provided for the wire mesh filter 109. That is, a limiting slot 110 is disposed at an inner side of the filter chamber 108, and three sides of the wire mesh filter 109 are inserted in the filter chamber 108 via the limiting slot 110, while the last side of the wire mesh filter 109 is fastened onto the housing 101 of the economizer by a bolt. Such a mounting manner enables the wire mesh filter 109 to withstand a greater impact pressure, thereby avoiding the wire mesh filter 109 from shifting when continuously impacted by the refrigerant in the working state.

Optionally, in the process of manufacturing the crescent-shaped economizer 100, in order to prevent welding slag from falling into the housing, a welded ring 107 may be further disposed in the housing 101, and the welded ring 107 has a shape matching the inner wall of the housing 101. A refrigeration system having the economizer 100 is further described below with reference to FIG. 3 and in combination with this embodiment. The refrigeration system includes a compressor 400, a condenser 200, a throttling component, and an evaporator 300 connected sequentially by a pipeline. In addition, the refrigeration system further includes the economizer 100. The economizer 100 is separately connected to the condenser 200 via a condenser outlet 102, connected to the evaporator 300 via an evaporator inlet 103, and connected to an intermediate stage of the compressor 400 via a compressor intermediate-stage inlet 104. The first section 101*a* of the economizer 100 is arranged in a manner of fitting a housing of the condenser 200. It can be found by comparison that a transverse space occupied by the condenser 200 and the economizer 100 in such an arrangement manner will be much smaller than that occupied by a condenser and an economizer in the conventional arrangement manner. It is thus clear that the space occupied by the refrigeration system having such an arrangement will also be much smaller than that occupied by a refrigeration system having a condenser and an economizer in the conventional arrangement manner.

Optionally, the first section 101*a* of the economizer 100 may also be designed such that it has a radius matching the housing of the condenser 200. For example, the first section 101*a* and the housing of the condenser 200 may have identical or similar radiuses, as long as the radiuses are more conductive to fitting arrangement of the economizer 100 and the condenser 200.

Figure 3:
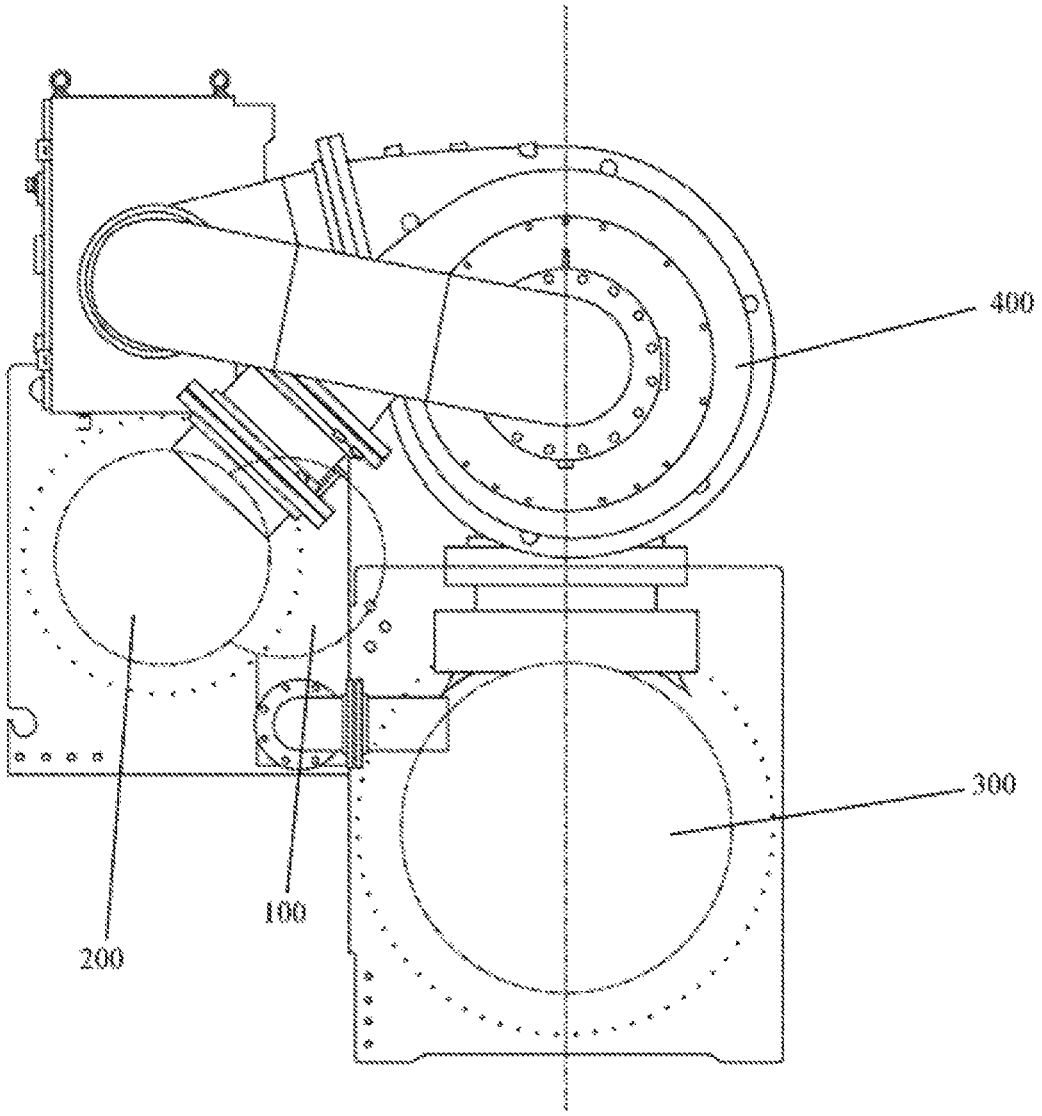
FIG. 3 is a schematic arrangement diagram of an embodiment of a refrigeration system of the present invention.

The working process of the refrigeration system of the present invention will be further described below with reference to FIG. 3.

When the refrigeration system starts to work, the gas-phase refrigerant discharged from the compressor 400 is pressed into the condenser 200; the gas-phase refrigerant flows in the condenser 200, and exchanges heat with water or other media in the flowing process; the cooled refrigerant flows from the lower portion of the first end 101*c* of the economizer 100 into the housing 101 via the condenser outlet 102, and flows in the housing 101 along a longitudinal direction. In this process, on one hand, larger droplets in the gas-liquid two-phase refrigerant suspended in the upper portion in the housing 101 will be broken up via the first flow-equalizing plate 105*a* and the second flow-equalizing plate 105*b* that deviate from each other, and further flow-equalizing is achieved via the third flow-equalizing plate 106*a*; then the refrigerant is filtered by the wire mesh filter 109, enters the filter chamber 108 from the bottom to the top, and finally enters the compressor 400 via the compressor intermediate-stage inlet 104 located at an upper portion of the filter chamber 108, to achieve air make-up. On the other hand, most of the liquid-phase refrigerant accumulating at a lower side in the housing 101 separately flows into the two flow-equalizing components via the first opening 105*c* and the second opening 106*b* below the first flow-equalizing plate 105*a*, the second flow-equalizing plate 105*b*, and the third flow-equalizing plate 106*a*, then enters the evaporator 300 via the evaporator inlet 103 located below the housing 101, exchanges heat therein, and then goes back to the compressor 400. Such circulation is repeated in the refrigeration system.

In the description of the present invention, it should be understood that direction or position relationships indicated by the terms "up", "down", "front", "back", "left", "right" and the like are direction or position relationships shown based on the accompanying drawings, and are merely intended to make it easy to describe the present invention and simplify the description, rather than indicating or implying that the device or feature indicated has to have a particular direction or be constructed and operated in the particular direction, and thus cannot be construed as limitations to the present invention.

The examples described above mainly illustrate the economizer and the refrigeration system having the economizer in the present invention. Although only some implementations of the present invention are described, persons of ordinary skill in the art should understand that, the present invention may be implemented in many other manners without departing from the principle and scope of the present invention. Therefore, the examples and implementations illustrated are construed as schematic rather than restrictive, and the present invention may cover various modifications and replacements without departing from the spirit and scope of the present invention defined by the appended claims.

The invention claimed is:

1. An economizer, comprising a housing having a first section and a second section; and a condenser outlet, an evaporator inlet, and a compressor intermediate-stage inlet that are disposed on the second section of the housing; wherein the first section has a contour matching a housing of a condenser, such that the first section fits the housing of the condenser; a first flow-equalizing portion arranged downstream of the condenser outlet in the housing; wherein a first opening is formed between an edge of the first flow-equalizing portion and an inner wall of the housing, and the first opening is located at a lower portion of the housing to allow a liquid-phase refrigerant to pass, a filter chamber located in the housing, wherein the compressor intermediate-stage inlet is located in the filter chamber and is in fluidic communication with the condenser outlet located outside the filter chamber, the filter chamber including a filter component configured to reduce the liquid-phase refrigerant directed to the compressor intermediate-stage inlet.

2. The economizer according to claim 1, wherein the first section has a concave curved contour; and/or the second section has a convex curved contour.

3. The economizer according to claim 2, wherein the second section has an arc length greater than that of the first section.

4. The economizer according to claim 1, wherein the first flow-equalizing portion comprises a first flow-equalizing plate and a second flow-equalizing plate provided with several flow-equalizing holes, respectively, the first flow-equalizing plate and the second flow-equalizing plate spaced from each other.

5. The economizer according to claim 4, wherein the first flow-equalizing plate and the second flow-equalizing plate are spaced from each other by 0.5-1 inches.

6. The economizer according to claim 1, wherein the first flow-equalizing portion is arranged adjacent to the condenser outlet.

7. The economizer according to claim 1, further comprising a second flow-equalizing portion arranged downstream of the first flow-equalizing portion in the housing.

8. The economizer according to claim 7, wherein the second flow-equalizing portion is arranged adjacent to a middle of the housing.

9. The economizer according to claim 7, wherein a second opening is formed between the second flow-equalizing portion and the inner wall of the housing, and the second opening is located at the lower portion of the housing to allow the liquid-phase refrigerant to pass.

10. The economizer according to claim 1, further comprising: at least one welded ring located in the housing, the at least one welded ring having a shape matching the inner wall of the housing.

11. The economizer according to claim 10, wherein the at least one welded ring comprises welded rings each located at two ends of the housing.

12. The economizer according to claim 1, wherein the filter component is a wire mesh filter.

13. The economizer according to claim 1, wherein the filter chamber is located at an upper portion of one end of the housing.

14. The economizer according to claim 13, wherein the filter component is located at a lower portion of the filter chamber.

15. The economizer according to claim 13, wherein a limiting slot is disposed at an inner side of the filter chamber, and the filter component is inserted in the limiting slot.

16. The economizer according to claim 1, wherein the condenser outlet is disposed at a lower portion of a first end of the housing; and/or the evaporator inlet is disposed at a lower portion of a second end of the housing; and/or the compressor intermediate-stage inlet is disposed at an upper portion of the second end of the housing.

17. A refrigeration system, comprising the economizer according to claim 1, and a condenser; wherein the first section of the economizer is configured to fit the housing of the condenser.

18. The refrigeration system according to claim 17, wherein the first section has a radius matching that of the housing of the condenser.

* * * * *